United States Patent [19]

Hansen et al.

[11] 4,013,214

[45] Mar. 22, 1977

[54] PLASTIC DISPLAY CONTAINER HAVING HINGED COVER

[75] Inventors: Roger P. Hansen; Larry J. Vis, both of Rockford, Mich.

[73] Assignee: Display Pack, Inc., Grand Rapids, Mich.

[22] Filed: May 17, 1976

[21] Appl. No.: 687,384

[52] U.S. Cl. ..... 229/44 R; 206/228; 206/45.34; 220/337

[51] Int. Cl.[2] ..... B65D 45/16; B65D 51/04; B65D 5/66

[58] Field of Search ..... 229/44 R, 2.5 EC; 206/45.34, 228; 220/337, 338, 372

[56] References Cited

UNITED STATES PATENTS

| | | | |
|---|---|---|---|
| 621,032 | 3/1899 | Chalmers | 220/337 X |
| 3,315,796 | 4/1967 | Dreyfuss | 206/228 |
| 3,568,914 | 3/1971 | Ahlmeyer | 206/45.34 |
| 3,576,271 | 4/1971 | Seeley | 229/44 R |
| 3,968,921 | 7/1976 | Jewell | 229/45 R |

FOREIGN PATENTS OR APPLICATIONS

| | | | |
|---|---|---|---|
| 1,002,543 | 10/1951 | France | 220/338 |
| 905,835 | 3/1954 | Germany | 220/337 |

*Primary Examiner*—Davis T. Moorhead
*Attorney, Agent, or Firm*—Price, Heneveld, Huizenga & Cooper

[57] ABSTRACT

A container moldable from a resilient, semirigid plastic material includes a transparent cover member and an opaque base member. The cover member includes a depending peripheral skirt having an angled slot formed in the junction of the skirt with a wall of the cover. The base member includes an outwardly extending, generally horizontal tab insertable through the slot in the cover member. A ramp-shaped detent formed integral with the tab prevents removal of the cover from the base when the cover is opened and provides a hinged connection between the cover member and the base member.

22 Claims, 6 Drawing Figures

PLASTIC DISPLAY CONTAINER HAVING HINGED COVER

BACKGROUND OF THE INVENTION

This invention relates to plastic containers and more particularly to a unique plastic container having a hinged cover.

Heretofore, various forms of plastic containers have been proposed for the storage or display of a wide variety of articles. Such containers generally include a base member and a cover member as well as an arrangement for hingedly interconnecting the two members. Some of these proposals employ a hinge element formed integral with the cover and the base by a thermo forming process. These arrangements do not readily permit forming of the base from a high impact plastic material and forming of the cover from a semi-rigid transparent plastic material. It is highly desirable to form the cover of a transparent material when employing the containers for the display of various articles such as baby shoes and the like. Also, a more rigid base results in better protection of the packaged article during transit and storage.

Several proposals have been made to overcome the shortcomings of the integral hinge construction. These arrangements provide some form of slot and tongue structure formed as part of or integral with either the cover or the base. These arrangements permit separate forming of the cover from one material and separate forming of the base from another material. The cover and base are subsequently interconnected to form the hinged container. An example of this latter arrangement may be found in U.S. Pat. No. 3,576,271 to Seeley, entitled HINGED PLASTIC CONTAINER and issued on Apr. 27, 1971.

As shown in the aforementioned patent, a relatively complex base structure includes an elongated slot formed in a horizontal surface of a collar portion of the base member. A cover is formed with an outwardly directed tab portion which is insertable through the slot. Although including some form of detent structure, the cover is easily removable from the base when in an open position.

With this type of container, which is employed both for storage and display of an article, the ease and economies of production are primary considerations. Also, the structures must be durable to withstand repeated handling during use while still providing a structure which is easily opened and closed and by which the cover may be readily retained on the base.

Therefore, a need exists for a hinged, two-piece container of relatively simple construction which is aesthetically pleasing, reliable and durable in use, and which is relatively easy and inexpensive to manufacture.

SUMMARY OF THE INVENTION

In accordance with the present invention, a unique plastic container having a hinged cover is provided by which the problems heretofore experienced are substantially alleviated. Essentially, the container includes a cover member having a depending peripheral skirt and a base member having an upstanding peripheral skirt. The cover and base are dimensioned so as to be superimposable. Adjacent or at the juncture between one of the skirts and its associated member, a slot is formed. The other member includes an outwardly directed, generally horizontal tab having an integral detent formed thereon. The tab and detent are insertable through the slot in order to hingedly interconnect the cover with the base. The detent and slot are dimensioned so that the peripheral skirt of one of the members is biased or deformed against the peripheral skirt of the other member. In this way, when the cover is open, it is virtually impossible, absent tearing of the material, to separate the cover from the base. Also, this deformation biases the cover to a closed position.

DETAILED DESCRIPTION OF THE PREFERRED EMBODIMENT

Figure 1:
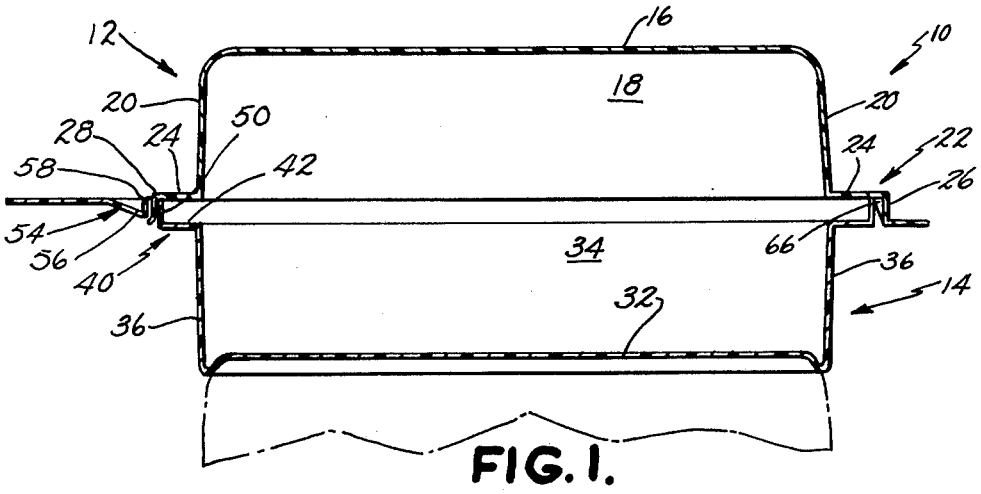
FIG. 1 is a side elevational view in cross section of a container in accordance with the present invention.
Figure 2:
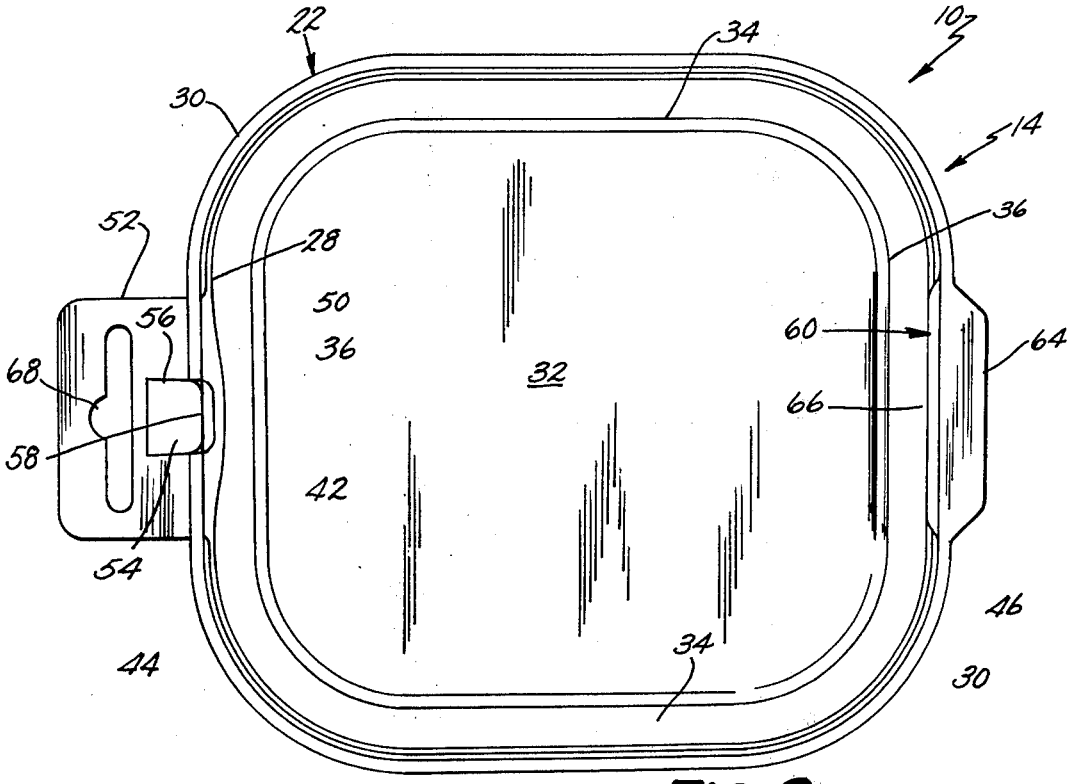
FIG. 2 is a bottom, plan view of a container in accordance with the present invention.
Figure 3:
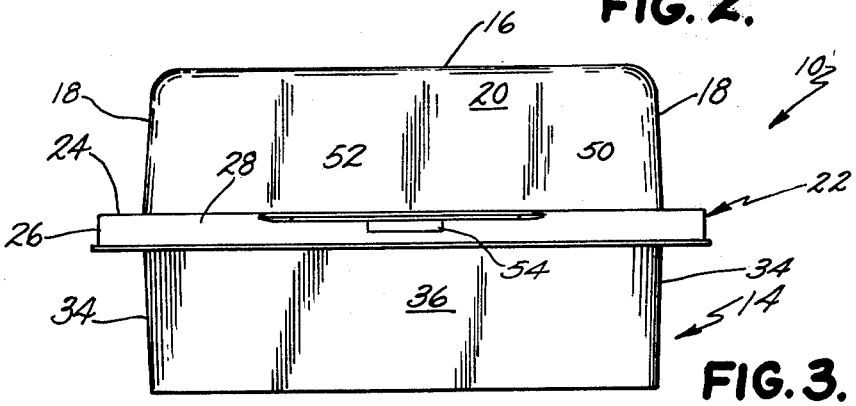
FIG. 3 is a rear, elevational view of the container of FIG. 2.
Figure 4:
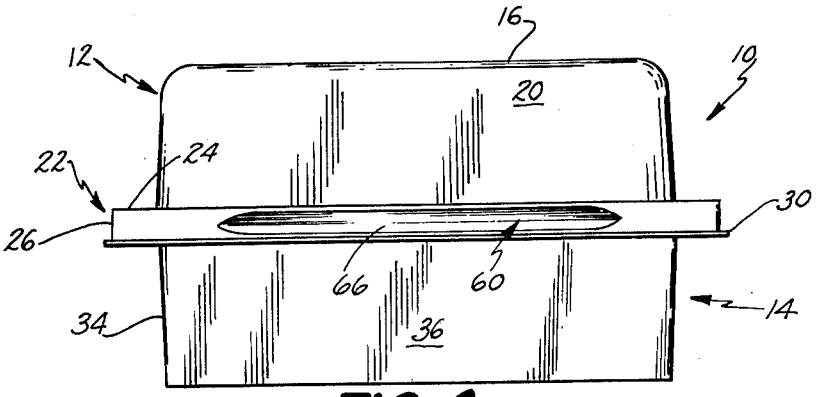
FIG. 4 is a front, elevational view of the container of FIG. 2.

The preferred embodiment of the plastic container having a hinged cover is illustrated in FIGS. 1–5 and generally designated 10. The container 10 includes a cover generally designated 12 and a base member generally designated 14. The cover member includes a top portion 16, depending side walls 18, and depending end wall 20 formed integral therewith. Extending around the periphery of the side walls and the end walls is a depending skirt portion generally designated 22. The skirt portion 22 includes an outwardly directed, generally horizontal surface 24 which extends, in the embodiment illustrated, around the entire periphery of the cover. Formed integral with and depending from the lateral edge of the horizontal surface 24 is a generally vertically positioned portion 26. The point where the vertical portion 26 joins the horizontal surface 24 defines a junction area 28. As best seen in FIGS. 3 and 4, the cover will usually be formed with an outwardly directed, lower lip 30 which extends around substantially the entire periphery of the vertical portion 26 of the depending skirt 22.

Figure 5:
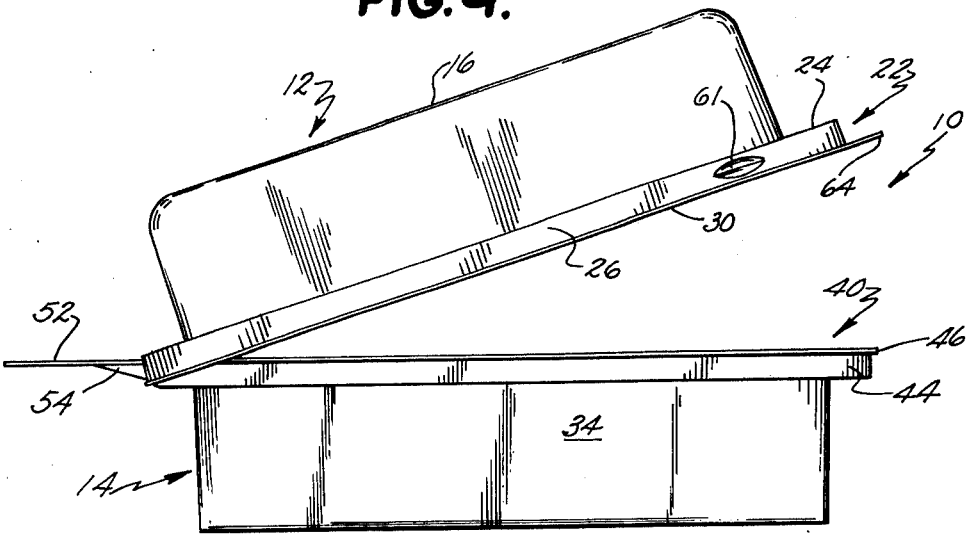
FIG. 5 is a side, elevational view showing the cover in a partially open position.

The base member 14 includes a bottom 32, raised slightly for reasons which will readily become apparent, side walls 34 and end walls 36. Formed integral with the side walls 34 and the end walls 36 and extending upwardly therefrom around the entire periphery of the base is an upstanding skirt portion generally designated 40. The upstanding skirt portion 40 is shaped in a manner very similar to the depending peripheral skirt of the cover 16. The skirt 40 includes a horizontally extending portion 42 and a generally vertically extending portion 44. As best seen in FIG. 5, the vertical portion 44 of the skirt 40 terminates in a generally outwardly extending lip 46 for reasons which will readily become apparent.

As best seen in FIGS. 1–3, a slot 50 is formed intermediate the ends of one ends walls 20 adjacent the area of the junction 28 between the horizontal portion 24 and the vertical, depending portion 26 of the cover 16. In the preferred construction, the slot is formed at an angle at the junction 28. The slot 50 is dimensioned so as to permit insertion of a horizontally extending tab or tongue 52 formed integral with the upstanding portion 44 of the peripheral skirt 40 of the base member 14. Also, the tab 52 is formed with an integral detent member 54. The detent member is illustrated as having a generally ramp-shape in cross section including a planar portion 56 which is angled downwardly toward the skirt 40 and a generally vertical portion 58.

In the preferred construction, the cover 16 is formed from a semirigid or resilient plastic material such as transparent polyvinylchloride. The base 14 is preferably formed from a fairly rigid, high impact opaque material such as polystyrene. In the alternative, the base could be formed from a transparent material. The ramp-like detent 54 permits the cover 16 to be easily connected to the base 14. As the tongue or tab 52 is inserted through the slot 50, the angled ramp will flex the resilient cover material to permit the depending skirt to slip over it. Once the tab has been pushed through the slot, the skirt may be pushed forwardly along its lower edge until it slips between the front wall 58 of the detent and the upstanding peripheral skirt 40 of the base or receptacle 14. As best seen in FIG. 2, when the cover is in this position, the detent will deform or bias the vertical portion of the depending skirt inwardly toward the upstanding peripheral skirt of the base. As will be more fully described below, this structural arrangement, including the tab, ramp-like detent and angled slot formed in the junction between the depending peripheral skirt and the end wall of the cover, biases the cover toward the closed position and greatly resists separation of the cover from the base when the cover is opened.

As best seen in FIGS. 2 and 4, intermediate the ends of the depending skirt 22, opposite the slot 50, is formed an elongated, inwardly directed depression or closing detent 60. Also, formed integral with the vertical portion 26 of the skirt 22, in the area of these depressions, is an outwardly directed grasping tab 64. The depression 60 and tab 64 function as a latch for the container. The depression 60 includes a sloped or ramp-like portion 66. Portion 66 is angled inwardly toward the cover member. The depression or detent terminates in a vertical face spaced from the horizontal surface 24 of the cover a distance approximately equal to the thickness of the lip portion 46 of the base 14. As should be readily apparent, the cover is closed and secured in the closed position by grasping tab 64 and pivoting the cover downwardly toward the base 14. Since the material is semirigid or resilient, the depression 60 will slip over the outwardly directed lip 46 and then be biased inwardly so as to catch the lip and maintain the cover in a latched, semilocked position. As seen in FIG. 5, additional closing detents 61 may be formed in the side portions of skirt 26 to increase the latching force keeping the cover closed.

In the alternative, a pair of spaced depressions may be used in place of the single depression 60. However, the single closing detent extending substantially the width of the cover end wall is preferred. The single depression has substantially greater frictional contact with the outwardly directed lip 46, thereby increasing the effectiveness of the latch maintaining the cover in a closed position.

As best seen in FIG. 1, since the bottom wall 32 of the base or receptacle 14 is raised or depressed inwardly with respect to the lower portion or terminal edges of the side walls 34 and the end walls 36, the containers 10 are readily stackable one upon the other. The cover 12 is dimensioned both transversely and longitudinally along its top portion 16 so as to nest or be receivable within the depression defined by the bottom wall 32. The side walls 34 and end walls 36 may be angled slightly outwardly to increase the storage space within the container while still permitting nesting. This stacking feature greatly facilitates the storage of the containers as well as the display of the containers at the retail or sales level.

In the preferred construction, the slot 50 would have a lengthwise dimension slightly greater than the width of the tongue or hinge tab 52. The width or transverse dimension of the slot 50 would be substantially equal to or slightly greater than the thickness of the tab 52. The depending skirt portion 22 of the cover would be dimensioned so as to just concentrically receive the upwardly extending skirt 40 of the base or receptacle 14. In other words, the cover member and base member are superimposable. Also, as best seen in FIG. 2, the tab 52 is preferably formed with an elongated slot 58. The slot 68 provides a ready means for attachment of the container to a display rod or hook. This feature greatly facilitates the display of the various articles contained within the receptacle.

Both the cover member and the base member are simply configured, generally rectangular structures which are easily producible from single sheets of material by conventional thermo forming processes employing vacuum or pressure forming apparatus. The relationship between the slot 50 and the hinge tab 52 results in a substantial increase in the resistance to separation of the cover from the base member when the cover is in an open position. When the cover is opened to an angle approaching 90°, the skirt 22 is trapped between the detent 54 and the skirt 40. This trapping action and deformation of the skirt in effect makes spearation of the cover from the base impossible absent tearing or destruction of the material itself. However, due to the resiliency of the material employed in forming the cover and proper dimensioning of the detent, when it is opened only slightly, for example 5° or less, the cover may be easily slipped off the tab 52. This feature increases the ease with which the cover and the base may be assembled at the factory or at the point of packaging. Also, the chance of the cover separating from the base at the point of use, as when a purchaser opens the container to touch the article contained therein, is substantially reduced or eliminated. The cover and the base member and the hinging arrangement are very simple in construction and yet extremely reliable in service. By increasing the depth dimension of the detent, separation of the cover may be resisted or prevented during the entire opening travel of the cover.

As the width of the container increases, the width of the tongue or tab 52 and the width of the detent 54 must, of course, be similary increased to obtain the desired results. In one form of the container employed for baby shoes, a tab width of approximately 35 percent of the container width and a detent width of approximately 30 percent of the tab width will provide the desired results. The slot should have a lengthwise dimension equal to or slightly greater than the width of the tab and a transverse dimension equal to or only slightly greater than the thickness of the tab. The detent may be dimensioned so as to permit the cover to slip off the tab when in a slightly open position but, however, locking the cover in place when it is pivoted to its fully open position.

Figure 6:
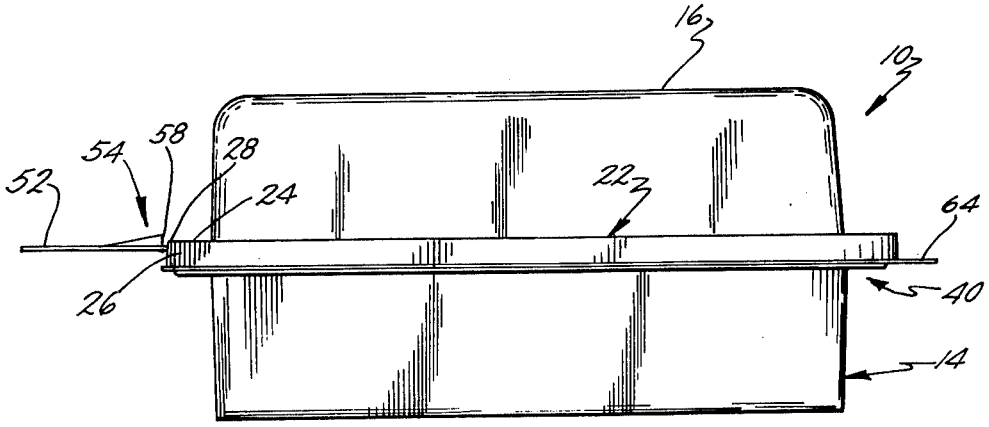
FIG. 6 is an alternative embodiment of a container in accordance with the present invention.

An alternative embodiment designated 10' is illustrated in FIG. 6 and portions which are the same as those of the preferred embodiment are designated with like numerals. The alternative embodiment differs from the previous embodiment in that a detent 54' extends upwardly through the upper face of the tab 52. Slot 50 is formed at the juncture between the horizontal surface 24 and the vertical surface 26 of the depending skirt as in the previous embodiment. The slot 50 in both embodiments may lie in a plane extending at an angle of 45° to the horizontal since it is formed at the 90° juncture between the horizontal surface and the vertical surface of the skirt portion. The detent 54' in the embodiment illustrated in FIG. 6 cooperates with the slot in a manner very similar to that of the previous embodiment. However, the detent does not catch or trap the skirt portion of the cover to bias it against the skirt portion of the base member.

As a result, resistance to separation of the cover member from the base member is greatest when the cover is opened to an angle less than 45°. As the cover is fully opned, due to the deformation of the material forming the depending peripheral skirt, the cover is readily separable from the tab 52. As a further alternative, the detent on the tab may extend both above and below the tab. This arrangement would effectively prevent separation of the container members during the entire opening travel of the cover.

With any of the embodiments, the detent formed integral with the tab as a raised or lowered depression or as both a raised and lowered depression including the ramp-like configuration resists or prevents separation of the cover from the base during a portion of the opening travel of the container.

As should be readily apparent from the foregoing description, either form of the container in accordance with the present invention may be easily and relatively inexpensively mass produced using conventional forming processes from single sheets of material. Since the cover may be formed separately from the base, it is readily formable from a transparent, resilient, semirigid material such as polyvinylchloride. The base portion may be formed from a more rigid, high-impact, opaque material such as polystyrene which is more suitable for the protection of the article contained therein. The tab 52 provides a convenient arrangement for the suspension of the container and hence readily adapts the container for the display of the article packaged within. Further, since the container is of two-piece construction, it may be manufactured and shipped to the point of use with a plurality of cover members nested together and a plurality of receptacle members nested together and placed in a shipping carton. The two-piece arrangement, therefore, substantially reduces the packaging space requirements for shipping the containers. The user may then place an article in the receptacle and connect the cover thereto.

It is expressly intended that the above description be considered that of the preferred embodiment of embodiments only. The true spirit and scope of the present invention will be determined by reference to the appended claims.

The embodiments of the invention in which an exclusive property or privilege is claimed are defined as follows.

1. A container moldable from a resilient, semirigid plastic material comprising:

a cover member having a depending peripheral skirt integral with the side walls of said cover;

a base member having an upstanding peripheral skirt integral with the side walls of said base and receivable within the depending skirt of said cover member;

one of said peripheral skirts having an angled slot therein at the juncture of said one of said peripheral skirts with one of said members; and hinge means extending through said slot and outwardly from the other of said peripheral skirts for permitting opening pivotal movement of said cover member relative to said base member and preventing removal of said cover member from said base member when said cover is pivoted to an open position.

2. A container as defined by claim 1 wherein said hinge means comprises:

an outwardly directed horizontal tab having a width substantially the same as the length of said slot.

3. A container as defined by claim 2 wherein said hinge means further includes detent means secured to said tab and positioned for preventing removal of said cover member from said base member when said cover member is pivoted to a fully open position.

4. A container as defined by claim 1 wherein said hinge means is part of said upstanding peripheral skirt of said base member and said slot is defined by said depending skirt of said cover member.

5. A container as defined by claim 3 wherein said hinge means is part of said upstanding peripheral skirt of said base member and said slot is defined by said depending skirt of said cover member.

6. A container as defined by claim 5 wherein said detent means comprises a ramp-like member integral with the undersurface of said tab, said ramp-like member being angled downwardly towards said base and having a face portion engaging said depending peripheral skirt when said cover member is pivoted to an open position, said slot and said ramp being dimensioned so that said tab may be slipped through said slot when said cover is almost closed, but preventing removal of said cover from said slot when said cover is fully opened.

7. A container as defined by claim 6 wherein said depending peripheral skirt of said cover member includes an inwardly directed depression thereby defining a closing detent and said upwardly extending peripheral skirt includes an angled lip whereby said closing detent engages said lip and resists opening of said container.

8. A container moldable from a resilient, semirigid plastic material, comprising:

a cover member having a top portion integral with outwardly angled, downwardly directed side and end wall portions, said cover member further including an outwardly directed, substantially horizontal surface integral with at least a portion of one of said end walls and a depending, substantially vertical surface integral with the lateral edge of said horizontal surface thereby defining a junction, said junction having a slot extending through a portion thereof;

a base member having a bottom portion and upwardly directed side and end walls, said cover member being superimposable on said base member;

a tab extending substantially horizontally outwardly from the lateral edge of one of said base member end walls and dimensioned so as to be insertable through said slot; and detent means extending outwardly from a surface of said tab for preventing removal of said cover from said base when said cover is pivoted to an open position, said cover being sufficiently resilient in the area of said slot to permit passage of said tab and said detent means through said slot for attachment of said cover member to said base member.

9. A container moldable from a resilient, semirigid plastic material as defined by claim 8 wherein said cover member is formed from a resilient semirigid transparent plastic material and said base member is formed from a high impact plastic material.

10. A container moldable from a resilient, semirigid plastic material as defined by claim 8 wherein said tab has a width dimension substantially equal to but slightly less than the length dimension of said slot.

11. A container moldable from a resilient, semirigid plastic material as defined by claim 10 wherein said slot has a transverse dimension substantially equal to but slightly greater than the thickness of said tab.

12. A container moldable from a resilient, semirigid plastic material as defined by claim 11 wherein said detent means extends outwardly from the lower face of said tab.

13. A container moldable from a resilient, semirigid plastic material as defined by claim 12 wherein said detent means comprises a projection having a ramp-like configuration including a planar portion angled downwardly towards said base member.

14. A container moldable from a resilient, semirigid plastic material as defined by claim 13 wherein said detent projection further includes a substantially vertical front wall portion integral with said angled planar portion, said wall portion spaced from said one of said base member end walls a distance slightly greater than the thickness of said substantially vertical surface of said cover member whereby when assembled, said cover member vertical surface is trapped between said detent means and said base member so that removal of said cover from said base is substantially prevented when said cover is in a fully open position.

15. A container moldable from a resilient, semirigid plastic material as defined by claim 11 wherein said detent means extends outwardly from the upper face of said tab.

16. A container moldable from a resilient, semirigid plastic material as defined by claim 15 wherein said detent means comprises a projection having a ramp-like configuration including a planar portion angled upwardly towards said cover member and a substantially vertical front wall portion integral with said planar portion whereby removal of said cover member from said base member is prevented when said cover is opened slightly but easily accomplished when said cover is fully opened.

17. A container moldable from a resilient, semirigid plastic material as defined by claim 14 wherein said substantially horizontal surface and said substantially vertical surface of said cover member extend around the entire periphery of said cover member integral with the end walls and side walls of said cover member.

18. A container moldable from a resilient, semirigid plastic material as defined by claim 16 wherein said substantially horizontal surface and said substantially vertical surface of said cover member extend around the entire periphery of said cover member integral with the end walls and side walls of said cover member.

19. A container moldable from a resilient, semirigid plastic material as defined by claim 17 wherein said vertical surface of said cover member includes an inwardly directed depression positioned opposite said slot and said base member includes an outwardly angled lip engageable by said depression to thereby resist opening movement of said cover with respect to said base.

20. A container moldable from a resilient, semirigid plastic material as defined by claim 18 wherein said vertical surface of said cover member includes an inwardly directed depression positioned opposite said slot and said base member includes an outwardly angled lip engageable by said depression to thereby resist opening movement of said cover with respect to said base.

21. A container moldable from a resilient, semirigid plastic material as defined by claim 19 wherein said cover is formed from a transparent, semirigid plastic material and said base member is formed from a high impact plastic material.

22. A container moldable from a resilient, semirigid plastic material as defined in claim 19 further including a pair of inwardly directed side depressions positioned on each side of said cover and defined by said vertical surface of said cover, and said outwardly angled lip of said base extends along the sides of said base and is engageable by said side depressions.

* * * * *

UNITED STATES PATENT AND TRADEMARK OFFICE

CERTIFICATE OF CORRECTION

PATENT NO. : 4,013,214

DATED : March 22, 1977

INVENTOR(S) : Roger P. Hansen and Larry J. Vis

It is certified that error appears in the above-identified patent and that said Letters Patent are hereby corrected as shown below:

Column 2, line 34:

"wall" should be --walls--.

Column 2, line 63:

After "one" insert --of the--.

Column 2, line 63:

"ends" second occurrence should be --end--.

Column 4, line 20:

"58" should be --68--.

Column 4, line 37:

"spearation" should be --separation--.

Column 5, line 60:

"of", second occurrence should be -- or --.

CERTIFICATE OF CORRECTION

Patent No. 4,013,214 Dated March 22, 1977

Inventor(s) Roger P. Hansen et al.

It is certified that error appears in the above-identified patent and that said Letters Patent are hereby corrected as shown below:

Column 8, line 43, "in" should read -- by --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*